US006512173B1

(12) United States Patent
Muth

(10) Patent No.: US 6,512,173 B1
(45) Date of Patent: Jan. 28, 2003

(54) INSULATION PLATES WITH PROTECTION AGAINST ELECTROMAGNETIC FIELDS

(75) Inventor: Andreas Muth, Mannheim (DE)

(73) Assignee: Saint-Gobain Isover, Courbevoie (FR)

( * ) Notice: Subject to any disclaimer, the term of this patent is extended or adjusted under 35 U.S.C. 154(b) by 0 days.

(21) Appl. No.: 09/530,259

(22) PCT Filed: Oct. 7, 1998

(86) PCT No.: PCT/EP98/06368

§ 371 (c)(1),
(2), (4) Date: Aug. 17, 2000

(87) PCT Pub. No.: WO99/22085

PCT Pub. Date: May 6, 1999

(30) Foreign Application Priority Data

Oct. 28, 1997 (DE) ..... 197 47 622

(51) Int. Cl.[7] ..... H05K 9/00

(52) U.S. Cl. ..... 174/35 MS; 174/35 R; 361/818

(58) Field of Search ..... 174/35 MS, 35 R, 174/35 GC; 361/753, 799, 800, 816, 818; 428/195, 256, 284, 285

(56) References Cited

U.S. PATENT DOCUMENTS 4,408,255 A * 10/1983 Adkins ..... 361/382
4,900,877 A * 2/1990 Dubrow et al. ..... 174/35 GC
4,965,408 A * 10/1990 Chapman et al. ..... 174/35 MS
5,008,486 A 4/1991 Terakawa et al.
5,223,327 A * 6/1993 Bihy et al. ..... 428/195
5,230,763 A 7/1993 Roth et al.
5,776,580 A * 7/1998 Rasmussen et al. ..... 428/74

FOREIGN PATENT DOCUMENTS

| | | |
|---|---|---|
| DE | 29700422 | 1/1997 |
| DE | 297 06 997 | 8/1997 |
| DE | 296 11 617 | 9/1997 |
| EP | 776153 | 2/1996 |

* cited by examiner

*Primary Examiner*—Dean A. Reichard
*Assistant Examiner*—Carmelo Oliva
(74) *Attorney, Agent, or Firm*—Pillsbury Winthrop LLP

(57) ABSTRACT

An insulation plate 1 out of mineral wool, for protection against detrimental environmental influence due to electromagnetic fields has an electrically conducting layer 2 on its surface, which preferably consists of a perforated aluminum film. For connection to form a wall lining, the layer 2 at its margin overlaps with adjacent insulation plates or the electrical connection with one another is effected with the aid of a electrically conducting adhesive tape out of aluminum, the entire shielding surface being connected to ground therein.

16 Claims, 2 Drawing Sheets

INSULATION PLATES WITH PROTECTION AGAINST ELECTROMAGNETIC FIELDS

This application is the national phase of international application PCT/EP98/06368 filed Oct. 7, 1998 which designated the U.S.

BACKGROUND OF THE INVENTION

1. Field of the Invention

The invention pertains to an insulation plate with protection against detrimental environmental influence by electromagnetic fields.

2. Description of Related Art

Electromagnetic sources, like e.g. high-frequency transmitters (broadcasting, radar, mobile radiotelephone network, industrial radiotelegraphy), high-voltage lines or different kinds of antennae in high-frequency as well as low-frequency range can cause effects detrimental to health to living beings as well as impairment of electronical systems, as can e.g. be found in rooms with highly sensible measurement and control apparatus. The fact that an accumulation of electromagnetic fields in increasing manner plays a part as possible influence detrimental to health on the human body (so-called electrosmog), it not only reflected by the continuous discussions and tests by famous institutes and other organizations but also is increasingly manifested in regulations relating to emission protection legislation. These regulations stipulate limit values which are binding for those erecting and operating locally fixed current supply means and transmission radio systems with respect to electromagnetic radiation emission and/or the electromagnetic fields of their systems.

In these regulations a difference is made between high-frequency and low-frequency systems, which on one hand relate to locally fixed transmission radio systems with electromagnetic fields in a frequency range from e.g. 10 MHz up to 300,000 MHz and on the other hand relate to aerial lines and underground cables with a frequency of e.g. 50 Hz and a voltage of e.g. 1000 V or more. In addition, long-distance and overhead railway traction current lines including the transformer and switching stations with a frequency of e.g. 16⅔ Hz or 50 Hz and electro-transformation plants with a frequency of e.g. 50 Hz and a primary voltage of e.g. 1,000 V or more are sources of electromagnetic fields.

According to a pertinent regulation of the Federal Emission Act electric and magnetic field strengths may amount to 32 times the limit for high-frequency systems, as long as they are operated in pulsed operation, and low-frequency systems may reach twice this value, when they do not total to more than 5 percent of a period of one day. This alone shows that in spite of an existing regulation the persons living close to such plants and installations still can be exposed to electromagnetic fields with comparatively high electric and magnetic field strengths and thus a demand for individual measurements for protection against a possibly detrimental excess offer of electromagnetic fields for an individual prevails in increasing manner.

This is aggravated by the fact that the amount of compatibility with respect to electromagnetism is under discussion also in professional circles, where the opinion is partly held that the limits presently fixed are too high.

It is true that already more strict European pre-standards ENV 50166/1 and ENV 50166/2 for the European EMV regulations (electromagnetic compatibility regulations) of the European Union are existing, however, they are not yet in force.

In the electromagnetic radiation spectrum a difference is made between high-frequency and low-frequency fields. The effects of high-frequency and low-frequency fields onto the human organism are different. Thus, e.g. sensible persons in the vicinity of overhead lines/underground cables (low-frequency plants) frequently complain about not having slept well.

But also high-frequency plants, like e.g. locally stationary transmission radio systems and mobile radiotelephone apparatus (e.g. handies), in their electromagnetic radiation under certain circumstances can be detrimental to health. Thus, e.g. a study of the Australian Telecom a.o. states that an increased risk of cancer caused by the frequent use of handies cannot be excluded. Moreover, it has to be noted that the important feature for the biologic effects of high-frequency electromagnetic fields is the portion of energy taken in by the human body. A dominant effect of the high-frequency fields is heating of the tissue, as the major part of the absorbed energy is converted into heat (so-called thermal effect). The determination of a limit value thus is based on energy absorption as reference magnitude.

Like the location, also time is an essential factor of exposure of human tissue to electromagnetic radiation and in this respect whereabouts where people stay continually, like e.g. residential buildings, hospitals, schools, kindergartens, places of work, playgrounds, gardens and other places where people regularly stay longer, are of particularly relevance. Thus, it is within the interest of the person staying there that the respective buildings are protected against detrimental environmental influences of electromagnetic sources—namely electrosmog.

Already, electrosmog protection systems are known in connection with a facade lining (DE 297 00 422), in which for protection two or three metal tissue mats one positioned on top of the other, with a total thickness of at east 10 to 15 cm are used. Herein, the mats either directly are applied to the wall to be covered or are held by means of a adhesive mortar layer or in case of a thermally insulated facade the mats are put on the thermal insulation plates used herein and are held by a reinforcing glue applied thereon, a plaster lining in addition being applied subsequently. Such a protection system having a thickness of at least 10 cm requires special fixation measurements in order to guarantee hold to the building wall, this in case of fixing anchors meaning thermal bridges. Furthermore, a suitable and reliable setting of the mat ribs to the frequency of the incident electromagnetic waves probably is very difficult.

In the European patent application EP 0 776 153 A2 a method for protecting rooms against electromagnetic radiation is described, in which the rooms are plastered with a thin plaster layer of not more than 2 mm thickness out of gypsum, which contains at least 0.8 percent by weight of carbon fibers, the cemented thin plaster layer being connected to ground in conducting manner. This process, however, does not include simultaneous equipment of the wall to be plastered, with a thermal insulation and by the admixture of the carbon fibers to the gypsum no definite alignment/orientation of the individual fibers is created, whereby only a limited shielding effect against electromagnetic radiation is possible.

BRIEF SUMMARY OF THE INVENTION

It is the object of the invention to permit an efficient protection against electromagnetic fields using simple measurements of insulation technology. Therein, in addition to good handling also quick, safe and simple assembly during realization of wall linings is to be rendered possible.

In accordance with the present invention the object is solved by the features contained in the characterizing clause of patent claim 1, preferred further developments of the invention being characterized by the features contained in the subclaims.

In accordance with the present invention, protection against disturbing electromagnetic fields is effected by an integral composite out of the insulation plate and an electrically conducting layer applied thereon, which layer is formed as fleece e.g. with metal threads, a perforated or punched thin metal film, a metal reinforcement and/or a woven metal wire cloth or carbon fleece. Herein, it is important that the electrically conducting layer is made open to diffusion, namely for reasons of thermal insulation technology of the insulating plates.

In accordance with a preferred further development, there metal threads and/or the woven metal wire cloth, respectively, are arranged with an aperture size of 1 mm or less and a wire/thread diameter of 0.1 to 1 mm.

In further development of the invention it is provided that paramagnetic as well as diamagnetic and ferromagnetic materials can be used for forming the metal threads, the thin metal film, the woven metal wire cloth and the metal reinforcement.

The insulation plates in accordance with the present invention can in assembled condition be mutually connected in conductive manner in the area of their cross joints using adhesive tapes made from aluminum so that in the total of the wall lining a closed conductive layer shell is created which acts as Faraday cage against the electromagnetic fields. In order to make it effective, connection to ground is effected by a separate means on the electrically conducting layer.

By applying a fleece with e.g. metal threads, a punched or perforated thin metal film or a woven metal wire cloth, the demanded diffusion openness of the insulation plates of mineral wool is guaranteed. Moreover, the layer solidly applied onto the insulation plate by covering can act as formation of the insulation plate increasing grip, whereby the adhesive properties e.g. of an adhesive layer or a plaster layer to the insulation plate can be improved under certain circumstances.

Electrically connecting the individual insulation plates can also be effected in that the electrically conducting layer applied protrudes in the marginal area of the insulation plate, preferably in angle-side manner in a corner area, so that these protruding marginal areas overlap with the layers of adjacent insulation plates.

In order to create an insulation plate for protection against detrimental electromagnetic fields which range e.g. in a frequency range of 3 kHz to 40 GHz, a distance of the individual metal wires, metal threads or metal strips of 1 mm turned out to be meaningful depending on this frequency range, as this when converted corresponds to a wave length of 300 GHz and less. For the efficiency of the shielding effect, however, also the diameter of the individual metal wires, metal threads and/or metal strips. respectively, has to be accounted for, which turned out to preferably amount to 0.1 to 1 mm. As the manufacture of such a woven metal wire cloth in most cases is very expensive and as compared to a mineral wool plate is comparatively inflexible, the use of a carbon fleece or a perforated or punched thin aluminum film is preferred. Alternatively, system offerers have the possibility to achieve the electromagnetic shielding by a metal reinforcement. However, also here a closed screen, i.e. a closed layer shell, must be created for guaranteeing the protective effect and for keeping the interior of this screen, i.e. the inside rooms of a building, free of disturbances.

The present invention is further described in the detailed description which follows, by reference to the noted drawings by way of non-limiting exemplary embodiments, in which like reference numerals represent similar parts throughout the several views of the drawings, and wherein:

DETAILED DESCRIPTION

Figure 1:
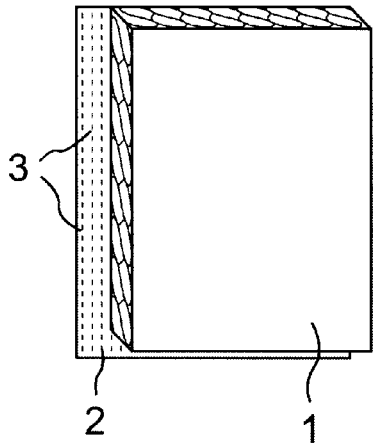
FIG. 1 is a perspective view of an individual insulation plate for protection against electrosmog with applied electrically conducting layer, of which only the protruding marginal areas can be seen.
Figure 2:
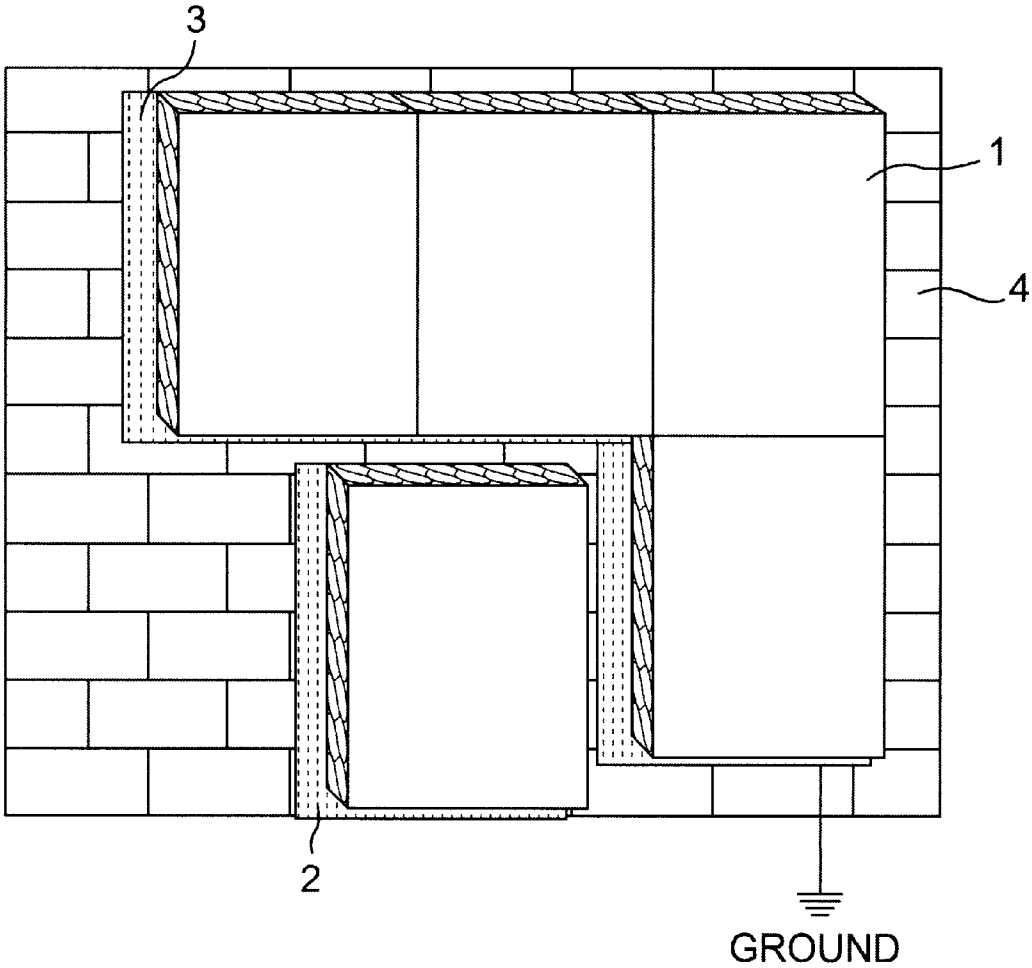
FIG. 2 is a perspective view of several insulation plates arranged one beside the next, of FIG. 1 which in common arrangement form a wall lining.

FIG. 1 shows an exemplary embodiment of a single insulation plate 1 for shielding electrosmog. The insulation plate 1 in the embodiment illustrated is made of mineral wool. An electrically conducting layer 2 is applied on at least one surface of the insulation plate 1 for shielding electromagnetic radiation. The electrically conducting layer 2 in a comer area has laterally protruding marginal strips 3, which serve as a contact area to adjacent insulation plates arranged in composition, as illustrated in FIG. 2.

In an exemplary embodiment, the electrically conducting layer 2 is made of a perforated aluminum film. However, the electrically conducting layer may also be made of a glass fleece with metal threads, a carbon fleece or a woven metal wire cloth. Alternatively, however, a connection between the electrically conducting layer and the insulation plate can be effected mechanically.

The material of the electrically conducting layer should be a ferromagnetic, paramagnetic or diamagnetic or preferably an otherwise electrically conducting material, e.g. carbon.

In order to guarantee efficient shielding against electromagnetic fields in the frequency range of 3 kHz to 40 GHz, the individual metal wires, metal fibers or metal strips depending on this frequency range are arranged with a wire/thread diameter of 0.1 to 1 mm with a distance of 1 mm.

FIG. 2 shows how several insulation plates in accordance with the present invention can be arranged one beside the next on an outside wall 4 as wall lining in order to obtain an efficient shielding against electrosmog together with thermal insulation within a building. Herein, the insulation plates are positioned on the outside wall with their electrically conducting layer 2, wherein the marginal strips 3 each come to lie under adjacent insulation plates in overlapping position. Thus, automatically an overlapping of the individual layers 2 results, serving for shielding against electrosmog, and simultaneously an anyway closed shielding shell over the entire building is obtained, which then in addition is connected to ground, too.

Figure 3:
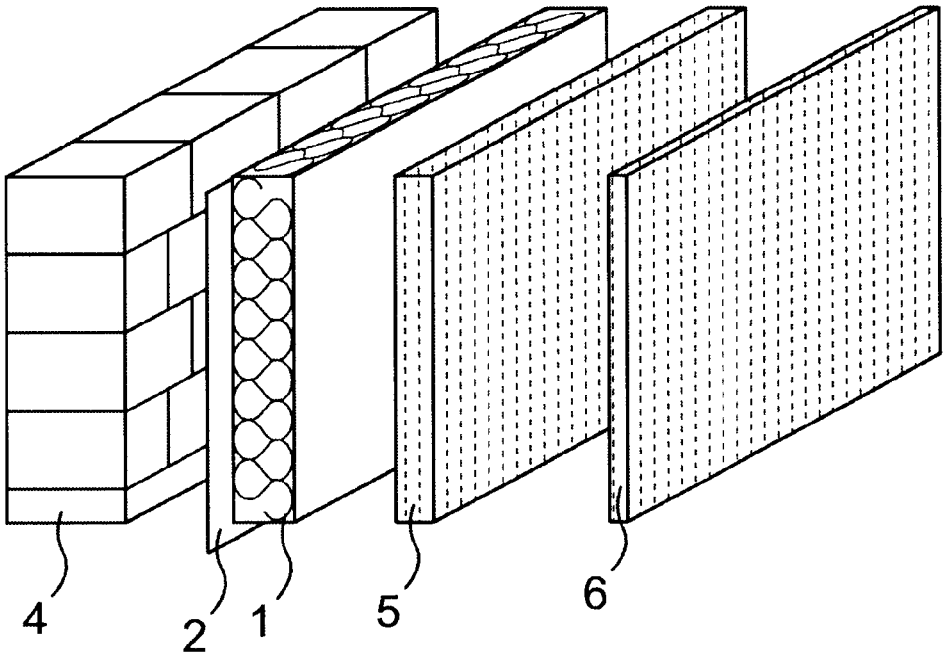
FIG. 3 is a broken-down cross-sectional view of a typical construction of a thermal insulation composite system for a facade, in which the insulation plate in accordance with the present invention is integrated.

FIG. 3 shows an exploded view of insulation of a house wall. The insulation includes a thermal insulation composite system in which the electrically conducting layer 2, e.g., a glass fleece 2 with metal threads, is applied onto the surface of the insulation plate 1. Because of the open structure of the glass fleece 2, diffusibility of the entire insulation plate 1 is still guaranteed. Although the fleece 2 is shown between the wall 4 and insulation plate 1, the fleece may also be disposed on the external surface of the insulation plate 1, i.e., between a plaster layer (5, 6) and the insulation plate. In the present case the plaster layer includes a basic plaster 5 with reinforcement and a finished plaster 6.

Figure 4:
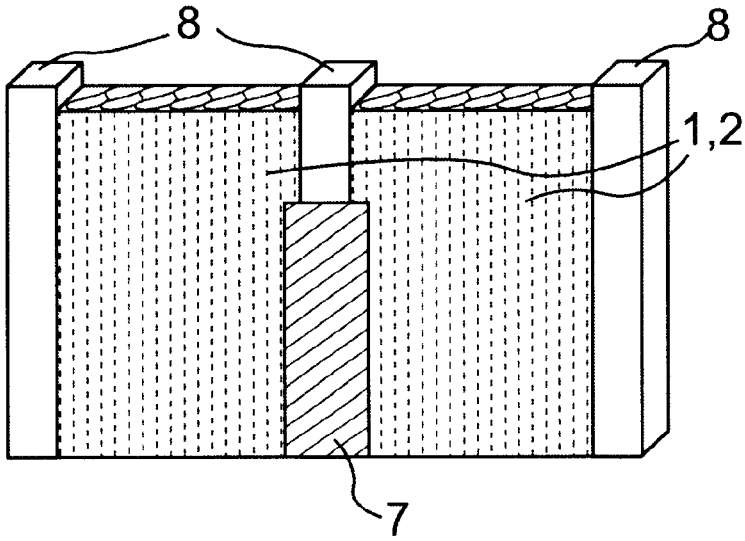
FIG. 4 is section of a steep roof shown in perspective view, in which the insulation plate in accordance with the present invention can be used.

FIG. 4 shows a section of a steep roof in perspective view, where the insulation plate in accordance with the present invention is used on the inside between rafters 8. In this embodiment the electrically conducting layer faces the inside of the room, an electrical conduction between the individual insulation plates 1 being effected in that the electrically conducting layers of adjacent insulation plates across the rafters 8 are connected with an electrically conducting adhesive tape 7. As can be seen from this figure, in such case of use the laterally protruding marginal strips 3 can be done without.

What is claimed is:

1. A thermal insulation plate with integrated electromagnetic shielding comprising:

a thermal insulation layer formed of mineral wool;

at least one electrically conductive layer formed of at least one of a woven metal wire cloth material, a perforated metal film material, a punched metal film material, a metal reinforcement material, and a metal fleece material, said at least one electrically conductive layer being substantially open for diffusion, said at least one electrically conductive layer being affixed to said thermal insulation layer.

2. A thermal insulation plate as in claim 1, wherein said at least one electrically conductive layer includes at least one of a paramagnetic, diamagnetic, and ferromagnetic material.

3. A thermal insulation plate as in claim 1, wherein a marginal edge portion of said at least one electrically conductive layer protrudes laterally outwardly past at least one side of said insulation.

4. A thermal insulation plate as in claim 3, wherein said marginal edge portion of said at least one electrically conductive layer extends laterally outwardly past two or more sides of said insulation plate.

5. A thermal insulation plate as in claim 1, wherein said at least one electrically conductive layer includes a glass fleece having integrated metal threads, said metal threads providing the electrical conductivity.

6. A thermal insulation plate as in claim 1, wherein said at least one electrically conductive layer includes a carbon fleece providing the electrical conductivity.

7. A thermal insulation plate as in claim 1, wherein said at least one electrically conductive layer includes a woven metal wire cloth, said wire cloth including intermeshed metal wires, each having a diameter of 0.1 to 1.0 mm with an aperture size between said metal wires of 1 mm.

8. A thermal insulation barrier with integrated electromagnetic shielding comprising:

a plurality of thermal insulation plates, each of said thermal insulation plates including:
a thermal insulation layer formed of mineral wool;

at least one electrically conductive layer formed of at least one of a woven metal wire cloth material, a perforated metal film material, a punched metal film material, a metal reinforcement material, and a metal fleece material, said at least one electrically conductive layer being affixed to said thermal insulation layer, wherein a marginal edge portion of said electrically conductive layer protrudes laterally outwardly past at least one side of said insulating plate; and each of said thermal insulation plates are disposed in abutting juxtaposed relation with adjacent thermal insulation plates such that marginal edge portions of each of said thermal insulation plates are overlapped by electrically conductive layers of adjacent thermal insulation plates so as to be in direct electrically conductive contact therewith.

9. A thermal insulation barrier as in claim 8, wherein said marginal edge portion of said electrically conductive layer extends laterally outwardly past two or more sides of each insulating plate.

10. A thermal insulation barrier as in claim 8, wherein said electrically conductive layer includes a glass fleece having integrated metal threads, said metal threads providing the electrical conductivity.

11. A thermal insulation barrier as in claim 8, wherein said electrically conductive layer includes a carbon fleece providing the electrical conductivity.

12. A thermal insulation barrier as in claim 8, wherein said electrically conductive layer includes a woven metal wire cloth, said wire cloth including intermeshed metal wires, each having a diameter of 0.1 to 1.0 mm with an aperture size between said metal wires of 1 mm.

13. A thermal insulation barrier with integrated electromagnetic shielding comprising:

a plurality of thermal insulation plates, each of said thermal insulation plates including;
a thermal insulation layer formed of mineral wool;

at least one electrically conductive layer formed of at least one of a woven metal wire cloth material, a perforated metal film material, a punched metal film material, a metal reinforcement material, and a metal fleece, said at least one electrically conductive layer being substantially open for diffusion, said at least one electrically conductive layer being affixed to said thermal insulation layer; and a conducting member electrically conductively connected to electrically conductive layers of adjacent spaced thermal insulation plates and spanning the space between said adjacent spaced thermal insulation plates to electrically conductively interconnect adjacent spaced thermal insulation plates.

14. A thermal insulation barrier as in claim 13, wherein said electrically conductive layer includes a glass fleece having integrated metal threads, said metal threads providing the electrical conductivity.

15. A thermal insulation barrier as in claim 13, wherein said electrically conductive layer includes a carbon fleece providing the electrical conductivity.

16. A thermal insulation barrier as in claim 13, wherein said electrically conductive layer includes a woven metal wire cloth, said wire cloth including intermeshed metal wires, each having a diameter of 0.1 to 1.0 mm with an aperture size between said metal wires of 1 mm.

* * * * *